US005109961A

United States Patent [19]

Bergman

[11] Patent Number: 5,109,961

[45] Date of Patent: May 5, 1992

[54] SUITCASE HAVING WHEELS AND FLEXIBLE BODY CONSTRUCTION

[76] Inventor: Mady I. Bergman, 216 Pacific Ave., Venice, Calif. 90291

[21] Appl. No.: 577,300

[22] Filed: Sep. 4, 1990

Related U.S. Application Data

[63] Continuation-in-part of Ser. No. 152,147, Feb. 4, 1988, Pat. No. 4,966,259.

[51] Int. Cl.[5] ..... A45C 5/14; A45C 7/00; A45C 13/04; A45C 13/26

[52] U.S. Cl. ..... 190/18 A; 190/109; 190/111; 190/119; 190/115; 190/903; 190/127; 150/117

[58] Field of Search ..... 190/18 R, 18 A, 109, 190/111, 115, 103-105, 127, 119, 903; D3/48, 71, 77; 150/117; 280/37

[56] References Cited

U.S. PATENT DOCUMENTS

| | | | |
|---|---|---|---|
| D. 254,819 | 4/1980 | Harrison | D3/71 |
| D. 270,112 | 8/1983 | Stark | D3/71 X |
| D. 274,387 | 6/1984 | Davis et al. | D3/71 |
| 2,577,670 | 12/1951 | Adams | 190/903 X |
| 3,061,057 | 10/1962 | Miller | 190/110 |
| 3,067,451 | 12/1962 | Levin et al. | 190/18 A X |
| 3,291,267 | 12/1966 | Pelavin | 190/111 |
| 3,878,939 | 4/1975 | Wilcox | 190/18 A X |
| 4,261,448 | 4/1981 | Myers et al. | 190/115 |
| 4,361,215 | 11/1982 | Sawai | 190/18 A |
| 4,420,068 | 12/1983 | Gerch | 190/111 X |
| 4,506,769 | 3/1985 | Franco et al. | 190/110 X |
| 4,733,259 | 3/1988 | Shih-Chen | 190/18 A |
| 4,738,340 | 4/1988 | Crespi | 190/18 R |
| 4,925,021 | 5/1990 | Pulichino, Jr. | 190/111 X |

FOREIGN PATENT DOCUMENTS

| | | | |
|---|---|---|---|
| 2454773 | 12/1980 | France | 190/18 A |
| 2538229 | 6/1984 | France | 190/18 A |
| 659112 | 10/1951 | United Kingdom | 190/109 |
| 2201335 | 9/1988 | United Kingdom | 190/115 |

*Primary Examiner*—Sue A. Weaver
*Attorney, Agent, or Firm*—Epstein, Edell & Retzer

[57] ABSTRACT

A suitcase including a plurality of independently, selectively accessible compartments defined by a pair of opposed sides and having retaining devices for securing articles in the compartments with respect to the sides of the suitcase, a handle attached to the sides of the suitcase for supporting such sides and for allowing the suitcase to be carried by the handle, wheels mounted on the suitcase for supporting the suitcase on the ground and a pull strap attached to the sides of the suitcase at forward and rearward points or attachment for manually pulling the suitcase along the ground.

15 Claims, 3 Drawing Sheets

80
30
60
100
58
16
120
32
26
120
120
78
40
14
98
38
68
70

10
80
6
86
90
78
88
20
104
28
30
12
38
40
90
88
94
92
102
26
14
95
6
98
24
82
22
84
18
110
112
96

SUITCASE HAVING WHEELS AND FLEXIBLE BODY CONSTRUCTION

BACKGROUND OF THE INVENTION

This application is a continuation-in-part of U.S. patent application Ser. No. 07/152,147, filed Feb. 4, 1988.

FIELD OF THE INVENTION

The invention relates broadly to a suitcase. More particularly, the invention relates to a compliant suitcase that can be pulled along the ground.

DESCRIPTION OF THE PRIOR ART

Conventional suitcases are generally fabricated from a rigid material and/or a rigid frame and, as such, are relatively heavy. When such a suitcase is packed with personal belongings, the combined weight of the suitcase and its contents presents a considerable burden. It is extremely difficult to carry a loaded conventional suitcase, and back strain and other physical discomforts can result from the repetitive lifting and prolonged carrying of the suitcase during the course of travel.

Although it has been proposed to provide rigid suitcases with wheels and a handle for pulling the suitcase along the ground, as exemplified in U.S. Pat. No. 4,838,396 to Krenzel and U.S. Pat. No. 4,813,520 to Lin, conventional wheeled suitcases possess numerous disadvantages. In particular, the pull handle is fastened at a singular, discrete location to the leading front panel of the suitcase and, therefore, the suitcase is very unstable and tends to wobble, swerve and even overturn when pulled and steered via the handle. Additionally, the number of and arrangement for the wheels on the bottom of the suitcase contributes further to instability by causing the suitcase to fall over when one or more of the wheels encounters cracks and bumps on the ground or otherwise is impeded in its motion while the suitcase is being pulled. The instability possessed by conventional wheeled suitcases thus precludes their use on many ground surfaces, on inclines and on stairs, and under conditions requiring frequent steering, such as walking through a crowded airport or other centers of transportation, and it is usually necessary to carry the entire weight of such suitcases in the normal manner.

A further drawback to conventional rigid suitcases is that they are inflexible and do not deform for accommodation in a designated space for transporting the suitcase, such as in the luggage compartment of a car or train and under an airplane seat. Indeed, when a rigid suitcase is forced into a space that is even slightly smaller than the exterior dimensions of the suitcase, the suitcase is apt to sustain irreparable structural damage and suitcases of this type are difficult to transport in the tight confines normally prevalent in land and air carriers.

Conventional rigid suitcases possess another deficiency in that it is difficult to gain access to the contents of the suitcase under typical travel conditions. Rigid suitcases are packed flat in a horizontally oriented position but, due to their configuration, are supported on the ground and carried in an upright position. When it is desired to open the lid on a fully packed suitcase during travel to gain access to specific items therein without removal of the entire contents, the suitcase must be laid flat to avoid spilling and shifting of the contents that could result in damage to or impairment of the contents. In many travel situations, it is impossible to locate sufficient space to lay the suitcase flat for opening and the suitcase must be opened in an upright position. When the lid of an upright suitcase is opened partially to remove specific items from the suitcase, the entire contents of the suitcase shift and gravitate toward th bottom of the suitcase and, consequently, can be impaired. Moreover, gravitation of the contents to the bottom of the suitcase applies weight against the suitcase lid, making the lid difficult to control and frequently causing the lid to swing to a fully open position with resulting spilling of the contents.

Even when a conventional suitcase can be successfully opened in an upright position during travel, or when sufficient space is available to open the suitcase in a horizontal orientation, the items desired to be removed therefrom must then be located among the contents of the suitcase. Finding specific items among the contents of a fully packed conventional suitcase is extremely difficult because conventional suitcases possess a single large compartment for holding the entire contents and the items to be found may not be readily visible or accessible when the suitcase is opened. The entire contents frequently must be sorted through and rearranged and, when the contents are clothing, this sorting and rearrangement causes the clothing to become wrinkled.

Furthermore, the weight and rigidity of conventional suitcases have prevented them from serving as carry-on bags for airline travel. A rigid carry-on bag must be significantly undersized to insure its fit beneath an airplane seat and, even in small sizes, a rigid bag is relatively heavy and cumbersome to carry. Carry-on bags, therefore, are generally made from a soft material and without a rigid structural frame to deform as necessary when positioned beneath an airplane seat. However, soft carry-on bags are themselves frequently undersized because a soft carry-on bag that takes full advantage of the space allocated beneath an airplane seat for carry-on luggage is, nevertheless, very heavy when fully packed. The usual dimensional limitation established by airlines for carry-on bags is that the sum of the length plus the width plus the height of the bag not exceed forty-five inches. A fully loaded bag satisfying this criterion can weigh over forty pounds and carrying such a bag can thus be very strenuous. In addition, a great deal of strength is required to push such a bag fully beneath the seat of an airplane. Soft carry-on bags, therefore, are also relatively small in size and have a limited storage capacity that is usually insufficient to hold the clothing and personal articles required for even a full day's use.

An additional disadvantage possessed by conventional soft carry-on bags is that they lack an structural support for the contents contained therein when the sides of the bag deform. Conventional soft baggage generally includes a single large compartment for carrying contents arranged on the bottom of the bag and the contents are permitted to move randomly in the compartment in response to deformation of the bag. As previously noted, movement of the contents is undesirable because it tends to adversely affect the condition and quality of the contents and conventional soft carry-on bags have proven to be unsuitable for carrying many types of articles, particularly clothing. The absence of support for the contents contained in conventional soft baggage has limited the size of such bags due to failure of relatively large sized bags to carry a large number of clothes and other items in a prearranged stable manner.

Furthermore, conventional soft baggage generally cannot be pulled along the ground by a pull handle because the pulling force produces significant deformation of the baggage resulting in an undesirable random shifting of the contents therein.

SUMMARY OF THE INVENTION

Accordingly, it is an object of the invention to provide a suitcase that can be pulled along the ground.

A further object of the invention is to provide a suitcase that can be pulled along the ground and down inclines and stairs without overturning.

Another object of the invention is to provide a suitcase that can be steered while being pulled along the ground without wobbling, swerving and overturning.

Moreover, it is an object of the invention to provide a suitcase that is deformable.

Yet a further object of the invention is to provide a suitcase that can be positioned beneath an airplane seat.

It is also an object of the invention to provide a soft suitcase wherein the contents of the suitcase are secured against shifting.

Furthermore, it is an object of the invention to provide a soft suitcase that can be pulled along the ground.

Still another object of the invention is to provide a carry-on suitcase capable of holding a large number of garments.

It is also an object of the invention to provide a suitcase that can be opened in an upright position without disarrangement of the contents.

These and other objects and advantages are obtained with the suitcase of the present invention as characterized by a body having a pair of opposed, vertically oriented, generally parallel first and second sides joined to a forward wall, an upper wall, a rearward wall and a lower wall. A first interior wall disposed in the body defines with the first side a first compartment for holding articles secured therein against the first side by adjustable straps and against the first interior wall by flaps. The first side is separable from the forward, upper and rearward walls to permit such side to be selectively moved to an open position to gain access to the first compartment. A second interior wall disposed in the body defines with the second side a second compartment for holding articles secured therein against the second interior wall by adjustable straps. The second side is selectively separable from the forward, upper and rearward walls to permit such side to be moved to a position allowing access to the second compartment. An intermediate compartment is defined in the body between the first and second interior walls, and the first compartment is selectively separable and movable with respect to the intermediate compartment to permit access to and opening of the intermediate compartment. A plurality of pockets are provided in the intermediate compartment for receiving and holding a variety of articles. A handle is attached to the first and second sides to generally encircle and support the body and to permit the suitcase to be carried via such handle. A plurality of wheels are rigidly mounted on the lower wall proximate the forward wall and a plurality of wheels are pivotally mounted on the lower wall proximate the rearward wall for supporting the suitcase on the ground. A pull strap is attached to the first and second sides for pulling the suitcase along the ground, such pull strap being secured to the respective sides at a forward and rearward point of attachment on such sides.

BRIEF DESCRIPTION OF THE DRAWINGS

These and other objects, features and many of the attendant advantages of the present invention will be appreciated more readily as they become better understood from a reading of the following description considered in connection with the accompanying drawings wherein like parts in each of the several figures are identified by the same reference characters, and wherein.

DESCRIPTION OF THE PREFERRED EMBODIMENT

Figure 2:
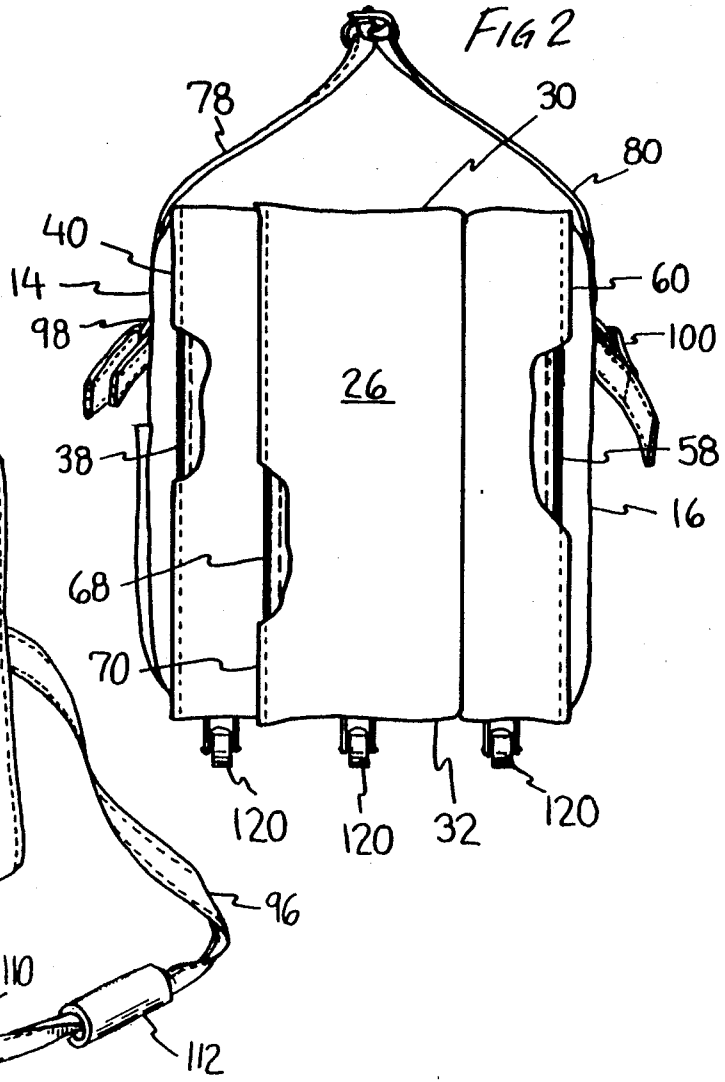
FIG. 2 is a front view of the suitcase of the present invention.

With reference to FIGS. 1-6, the suitcase 10 of the present invention includes a body 12 defined by a pair of vertically oriented, spaced, parallel opposing sides 14 and 16, each having a forward edge 18, an upper edge 20, a rearward edge 22, and a lower edge 24, a vertically oriented forward wall 26 joining forward edges 18, a vertically oriented rearward wall 28 disposed parallel to forward wall 26 joining rearward edges 22 a horizontally oriented upper wall 30 joining upper edges 20, forward wall 26 and rearward wall 28, and a horizontally oriented lower wall 32 disposed parallel to upper wall 30 joining lower edges 24, forward wall 26 and rearward wall 28.

Figure 1:
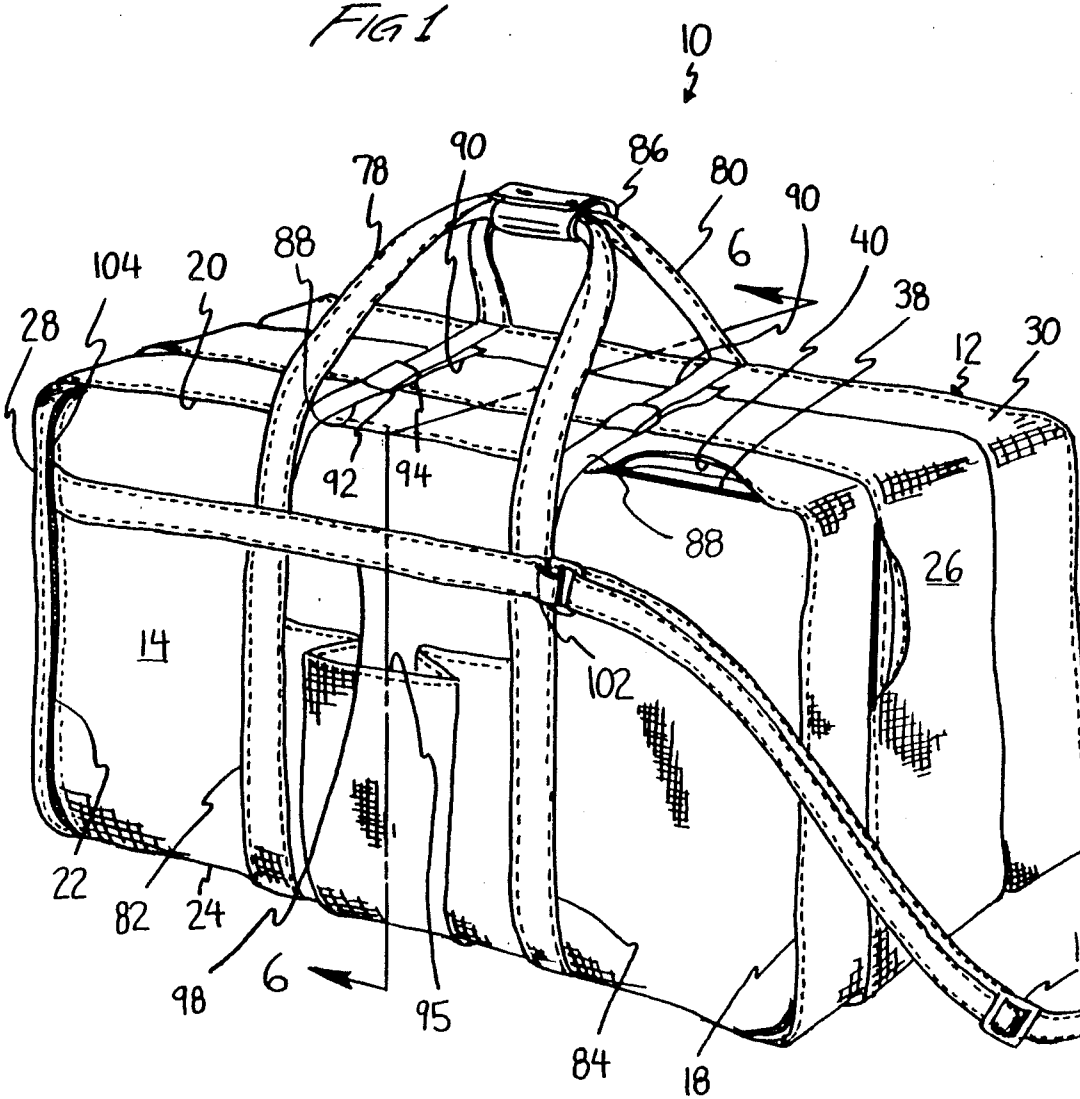
FIG. 1 is a perspective view of the suitcase of the present invention.
Figure 4:
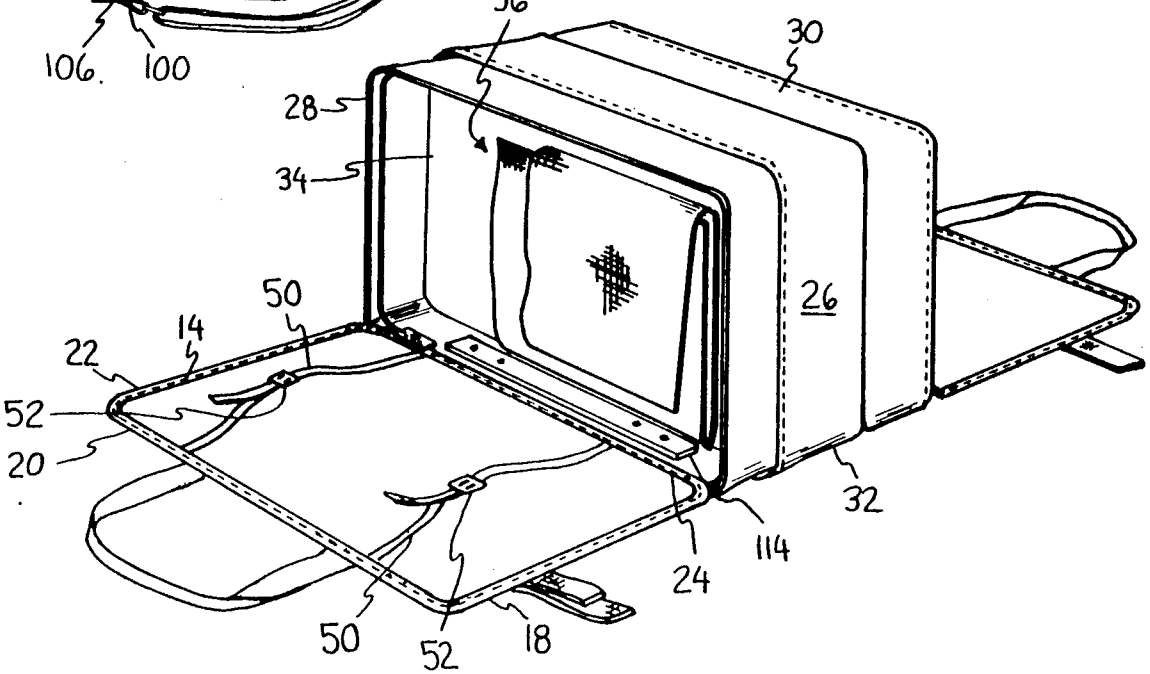
FIG. 4 is a perspective view of the suitcase of the present invention showing the sides of the suitcase in an open position.
Figure 5:
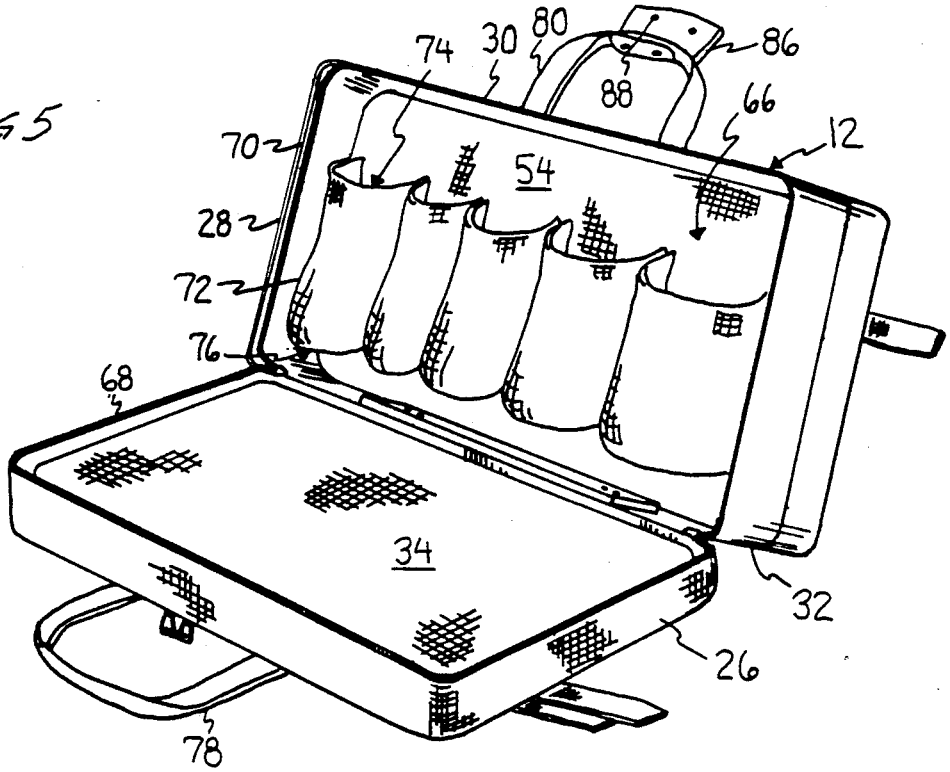
FIG. 5 is a perspective view of the suitcase of the present invention showing the intermediate compartment of the suitcase open.
Figure 6:
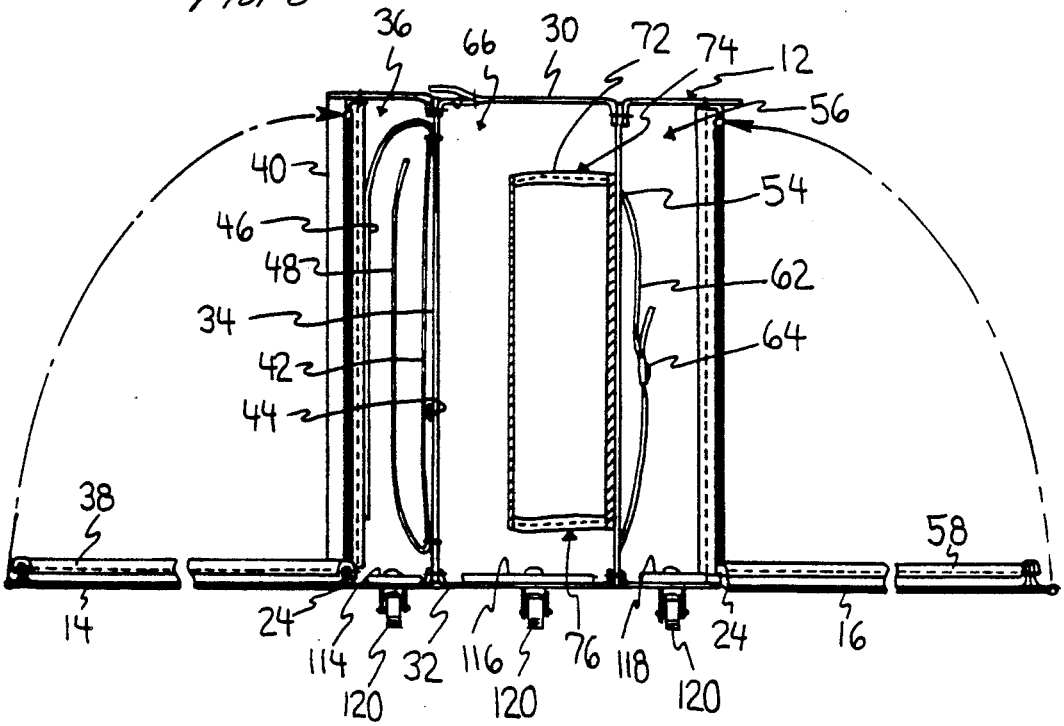
FIG. 6 is a side cross-sectional view of the suitcase of the present invention taken along line 6-6 of FIG. 1 and showing the sides of the suitcase in an open position.

As shown in FIGS. 4, 5 and 6, a first, vertically oriented interior wall 34 is disposed in body 12 spaced interiorly from an parallel to side 14, and an interior compartment 36 is defined between first interior wall 34, side 14, forward wall 26, rearward wall 28, upper wall 30 and lower wall 32. Lower edge 24 of side 14 is permanently joined to lower wall 32 and a zipper 38 is sewn on the forward edge 18, upper edge 20 and rearward edge 22 of side 14 and on forward wall 26, upper wall 30 and rearward wall 28 for continuously joining edges 18, 20 and 22, respectively, of side 14 to walls 26, 30 and 28, and to permit selective detachment of such edges from the respective walls to gain access to compartment 36 as shown in FIGS. 4 and 6. A zipper flap 40 extends over zipper 38 as shown in FIG. 1 to conceal zipper 38 from environmental elements such as rain and snow.

As illustrated in FIG. 6, a flexible sheet 42 is disposed in compartment 36 to extend over first interior wall 34, such sheet being continuously attached to interior wall 34 adjacent upper wall 30 and lower wall 32 to define a sleeve 44 open adjacent forward wall 26 and rearward wall 28. A first flap 48 is attached to interior wall 34 adjacent upper wall 30 to extend over sleeve 44 and a second flap 46 is attached to interior wall 34 adjacent lower wall 32 to similarly extend over sleeve 44. A pair of adjustable straps 50 are secured on side 14 to be disposed in compartment 36 when such side is joined to forward wall 26, upper wall 30 and rearward wall 28 by zipper 38. Straps 50 are positioned in spaced relation on side 14 parallel to forward edge 18 and rearward edge 22 and are secured to side 14 adjacent upper edge 20 and lower edge 24. A buckle 52 is mounted on straps 50 to permit the length of the straps as measured between upper edge 20 and lower edge 24 to be selectively increased and decreased.

A second, vertically oriented interior wall 54 is disposed in body 12 spaced interiorly from and parallel to sides 14 and 16. Second interior wall 54 is permanently joined to forward wall 26, upper wall 30, rearward wall 28 and lower wall 32, and an interior compartment 56 is defined between second interior wall 54, side 16, forward wall 26, upper wall 30, rearward wall 28 and lower wall 32. Lower edge 24 of side 16 is permanently joined to lower wall 32 and a zipper 58 is sewn on the forward edge 18, upper edge 20 and rearward edge 22 of side 16 and on forward wall 26, upper wall 30 and rearward wall 28 for continuously joining edges 18, 20 and 22, respectively, of side 16 to walls 26, 30 and 28 and to permit selective detachment of such edges from the respective walls to gain access to compartment 56 as shown in FIGS. 4 and 6. A zipper flap 60 extends over zipper 58 as shown in FIG. 2 to conceal zipper 58 from environmental elements such as rain and snow. A pair of adjustable straps 62 are secured on interior wall 54 to be disposed in compartment 56 in spaced parallel relation to forward wall 26 and rearward wall 28 as illustrated in FIG. 6, such straps being secured to second interior wall 54 adjacent upper wall 30 and lower wall 32. A buckle 64 is mounted on straps 62 to permit the length of the straps as measured between upper wall 30 and lower wall 32 to be selectively increased and decreased.

An intermediate interior compartment 66 is disposed between compartments 36 and 56, and is defined between first interior wall 34, second interior wall 54, forward wall 26, upper wall 30, rearward wall 28 and lower wall 32. Forward wall 26, upper wall 30 and rearward wall 28 are sectioned at first interior wall 34 to permit compartment 36 to be separated from intermediate compartment 66 via detachment of the section of forward wall 26, upper wall 30 and rearward wall 28 that defines compartment 36 from the section of forward wall 26, upper wall 30 and rearward wall 28 that defines intermediate compartment 66 to open intermediate compartment 66 as shown in FIG. 5. First interior wall 34 is permanently joined to lower wall 32 and a zipper 68 is sewn on the section of forward wall 26, upper wall 30 and rearward wall 28 defining compartment 36 adjacent interior wall 34 and on the section of forward wall 26, upper wall 30 and rearward wall 28 defining intermediate compartment 66 for continuously joining compartment 34 to intermediate compartment 66 and to permit selective detachment of compartment 34 from intermediate compartment 66 to gain access to intermediate compartment 66. A zipper flap 70 extends over zipper 68 as shown in FIGS. 1 and 2 to conceal zipper 68 from environmental elements such as rain or snow.

A plurality of elongated tubular pockets 72 are provided on second interior wall 54 to be disposed in intermediate compartment 66 as shown in FIGS. 5 and 6. Each of the pockets 72 has its major length oriented parallel to forward wall 26 and rearward wall 28 and includes an open top end 74 positioned medially between upper wall 30 and lower wall 32 and an open bottom end 76 spaced from lower wall 32.

As depicted in FIGS. 1 and 2, a handle 78 is secured on the exterior of side 14 and a handle 80 is secured on the exterior of side 16 of suitcase 10. Handle 78 includes a first end 82 and a second end 84 disposed in spaced relation on side 14 and secured to side 14 adjacent lower edge 24 to extend upwardly on side 14 generally parallel to forward wall 26 and rearward wall 28, and handle 80 is secured on side 16 in a similar manner. A flat pad 86 is attached to handle 80 and a fastener 88 is carried on pad 86 to permit pad 86 to be wrapped in tubular fashion around handle 78 and fastened in such position to hold handles 78 and 80 together to form a hand grip for carrying suitcase 10. A pair of straps 88 are secured on side 14 adjacent the first and second ends 82 and 84 of handle 78 to extend over a portion of upper wall 30 and a pair of straps 90 are similarly secured on side 16 adjacent the first and second ends of handle 80 to extend over upper wall 30. A male fastener 92 is mounted on the ends of straps 88 and a female fastener 94 is mounted on the ends of straps 90 for cooperative mating locking engagement with male fastener 92. Straps 88 and 90 are adjustably mounted with respect to fasteners 92 and 94 to permit the length of the straps to be selectively increased and decreased. A pocket 95 is provided on the exterior of side 14 between the first and second ends 82 and 84 of handle 78.

Figure 3:
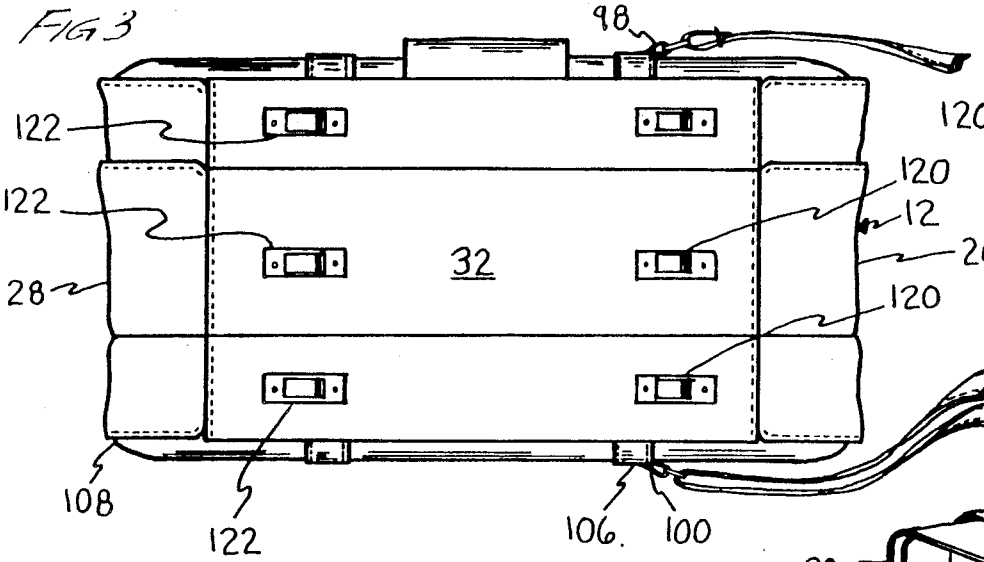
FIG. 3 is a bottom view of the suitcase of the present invention.

A flexible pull strap 96 is secured on suitcase 10 and includes a first end 98 secured on the exterior of side 14 and a second end 100 secured on the exterior of side 16 as shown in FIGS. 1, 2 and 3. First end 98 is secured to side 14 at a forward attachment point 102 proximate forward edge 18 and at a rearward attachment point 104 spaced rearwardly from forward attachment point 102, and the horizontal distance between the forward and rearward attachment points 102 and 104 for first end 98 is a major portion, i.e. more than fifty percent, of the horizontal distance between forward edge 18 and rearward edge 22 of side 14. Similarly, second end 100 is secured to side 16 at a forward attachment point 106 proximate forward edge 18 and a rearward attachment point 108 spaced rearwardly from the forward attachment point 106, and the horizontal distance between the forward and rearward attachment points 106 and 108 for second end 100 is a major portion, i.e. more than fifty percent, of the horizontal distance between forward edge 18 and rearward edge 22 of side 16. A buckle 110 is provided on pull strap 96 as shown in FIG. 1 to permit selective lengthening and shortening of the pull strap, and a tubular hand grip 112 is slidably mounted on pull strap 96 to permit the pull strap to be manually grasped via hand grip 112 to pull suitcase 10 in a forward direction.

As illustrated in FIGS. 4 and 6, a first stiffening panel 114 is secured in compartment 36 to extend over lower wall 32; a second stiffening panel 116 is secured in intermediate compartment 66 to extend over lower wall 32; and a third stiffening panel 118 is secured in compartment 56 to extend over lower wall 32. A wheel 120 is rigidly mounted on each of panels 114, 116 and 118 proximate forward wall 26 to extend exteriorly of lower wall 32, such wheels 120 having a common rotational axis that is oriented parallel to forward wall 26 and extends transversely between sides 14 and 16 to permit movement of the suitcase in a forward direction when the suitcase is manually pulled by pull strap 96. A wheel 122 is rotatably mounted on each of panels 114, 116 and 118 proximate rearward wall 28 to extend exteriorly of lower wall 32, such wheels 122 being mounted in alignment along a common line extending parallel to the rotational axis for wheels 120; however, wheels 122 are freely rotatable three hundred and sixty degrees to allow the wheels 122 to swivel or pivot for steering the suitcase 10 when it is pulled along the ground.

Preferably, sides 14 and 16, forward wall 26, upper wall 30, rearward wall 28 and lower wall 32 are fabricated of light-weight, durable, waterproof flexible fabric such as 1000 denier Kordura. Sides 14 and 16 are preferably rectangular in configuration, are equally sized, and the lower edges 24 of such sides are permanently secured to lower wall 32 by stitching, adhesive, rivets or the like. Similarly forward wall 26 and rearward wall 28 are preferably permanently joined to lower wall 32 by stitching, adhesive, rivets or the like. Forward wall 26 and rearward wall 28 are integrally, unitarily joined to upper wall 30 and, preferably, the forward, upper and rearward walls are formed from a continuous length of material as shown in FIG. 1.

Zippers 38, 58 and 68 are preferably dual-directional, each of such zippers having two heads for permitting selective partial opening of desired portions of the respective compartments. Sleeve 44, flaps 46 and 48, pockets 72, and straps 50 and 62 are preferably made from a high-strength nylon material permanently secured to body 12 by stitching or the like. Handle 78, straps 88 and 90, and pull strap 96 are preferably fabricated from a high-strength webbing and buckles 52, 64 and 110 and fasteners 92 and 94 are made from a high-strength plastic material. Pad 86 and hand grip 112 are preferably fabricated of a soft, water-resistant material comfortable when gripped by a user. Fastener 88 on pad 86 is preferably a metallic snap fastener although other types of fasteners are equally suitable. It is preferred that stiffening panels 114, 116 and 118 be made from a relatively rigid, high-strength material and that such panels be sewn on or secured to bottom wall 32 by adhesive or mechanical fasteners. Wheels 120 and 122 are preferably fabricated from a high-strength metallic or plastic material and are mounted by rivets or the like to panels 114, 116 and 118. Preferably, three wheels 120 and three wheels 122 are provided on the bottom of the suitcase 10. It is preferred that the sum of the length plus the width plus the height of suitcase 10 not exceed forty-five inches to allow the suitcase to be positioned beneath an airline seat although other dimensional configurations are equally acceptable. Preferably, the first and second ends of handles 78 and 80 are continuously secured to sides 14 and 16, such as by stitching, and the pull strap 96 is preferably continuously secured to sides 14 and 16 between the respective forward and rearward attachment points on such sides.

In operation, suitcase 10 is laid on side 16 and zipper 38 is opened to allow side 14 to be pivoted around lower edge 24 to fully open compartment 36. Clothing to be packed in the suitcase is folded to match the length of side 14 and is stacked in alternating fashion, i.e. waistband on left, waistband on right, etc., on the interior surface of side 14 The stacked clothing that can be held by side 14 is generally equivalent to four pair of slacks or the like for men and two pair of slacks and four skirts or the like for women, and the stacked clothing is secured in position on side 14 by tightening straps 50 around the arranged clothing via buckles 52. Flaps 46 and 48 are then pivoted to reveal sleeve 44. Sleeve 44 accommodates clothing that has already been worn and such clothing and other laundry items, if any, are folded and placed within sleeve 44 to be segregated from clean garments. Clothing is then folded to match the length of first interior wall 34 and stacked in alternating fashion on sleeve 44. The stacked clothing that can be held on sleeve 44 is generally equivalent to six shirts or the like and flap 46 is folded over this clothing. Additional clothing is then placed over flap 46 and flap 48 is then folded over the additional items, flaps 46 and 48 serving to prevent sliding and shifting of the clothing when the suitcase is closed. Side 14 is then pivoted to cover compartment 36 and zipper 38 is utilized to secure side 14 in a position closing compartment 36.

Suitcase 10 is then laid on side 14 and zipper 58 is opened to allow side 16 to be pivoted around lower edge 24 to fully open compartment 56. Clothing is then folded and packed in compartment 56 in the manner previously described, such compartment generally holding the equivalent of three suit jackets plus additional clothing items and personal articles. Straps 62 are then tightened via buckles 64 around the packed clothing in compartment 54, side 16 is pivoted over compartment 54 and zipper 58 is closed to secure side 16 in a position closing compartment 54.

Zipper 68 is opened to allow full access to intermediate compartment 66 as shown in FIG. 5 Items such as shoes, a hair dryer, curling iron, cans of hair spray, etc. are placed in tubular pockets 72 and additional clothing and personal articles are placed in the spaces above and below pockets 72. Zipper 68 is then closed and pad 86 is wrapped around handle 78 and fastened by fastener 88 to form a hand grip for carrying the suitcase. Fasteners 92 and 94 on straps 88 and 90 are joined to lock straps 88 and 90 together around the suitcase, such straps in effect forming a band, together with the ends of handles 78 and 80, encircling the body 12 and providing structural support along sides 14 and 16 for the contents of the suitcase.

Although suitcase 10 can be carried by handles 78 and 80, it is preferable in many situations to pull the suitcase along the ground. Wheels 120 and 122 support suitcase 10 when it is placed on the ground and hand grip 112 of adjustable pull strap 96 can be manually grasped to pull the suitcase along the ground in the forward direction. The number of and arrangement for the wheels 120 and 122 provide stability that enables the suitcase to be pulled and steered along all types of ground surfaces, down inclines and even down stairs without overturning. The freedom of rotation of wheels 122 makes the suitcase easy to steer and, in addition, allows the suitcase to be easily pushed in any direction, such as when pushing the suitcase beneath an airline seat. The suitcase 10 is easily deformable to fit in tight locations; however, the contents of the suitcase do not randomly shift during deformation and/or pulling of the suitcase because the interior packing arrangement for the suitcase utilizes the contents themselves to provide support for holding the shape of the suitcase and securing the contents therein. During travel, intermediate compartment 66 as well as compartments 36 and 56 can be selectively partially opened by the appropriate zippers 6 when the suitcase is in an upright position to remove items without disturbing items in the remaining compartments and without uncontrolled opening of the suitcase.

Inasmuch as the present invention is subject to many variations, modifications and changes in detail, it is intended that the subject matter discussed above and shown in the accompanying drawings be interpreted as illustrative and not in a limiting sense.

What is claimed is:

1. A flexible suitcase comprising:

a body including an upper wall, a lower wall, a pair of opposing side walls joined to said upper and lower walls, a pair of opposing end walls joined to said upper wall, said lower wall and said side walls, a first interior partition joined to said upper wall, said lower wall and said end walls and a second interior partition joined to said upper wall, said lower wall and said end walls, said body being made from a flexible material in its entirety;

a first compartment defined in said body between one of said side walls and said first partition;

a second compartment defined in said body between the other of said side walls and said second partition;

an intermediate compartment defined in said body between said first and second partitions;

means for selectively releasing said one side wall from said upper wall and said end walls to allow said first compartment to be selectively opened and closed;

means for selectively releasing said other side wall from said upper wall and said end walls to allow said second compartment to be selectively opened and closed;

means for selectively releasing one of said partitions from said upper wall and said end walls to allow said intermediate compartment to be selectively opened and closed;

a first stiffening panel independently secured on said lower wall in said first compartment;

a second stiffening panel independently secured on said lower wall in said first compartment;

a third stiffening panel independently secured on said lower wall in said intermediate compartment;

wheel means mounted on said stiffening panels for supporting said body on the ground; and handle means on said body for pulling said body along the ground.

2. A suitcase as recited in claim 1 wherein said one side wall includes a forward edge and a rearward edge and said other side wall includes a forward edge and a rearward edge.

3. A suitcase as recited in claim 2 wherein said handle means is secured on said one side wall at a first forward attachment point and at a first rearward attachment point and on said other side wall at a second forward attachment point and at a second rearward attachment point.

4. A suitcase as recited in claim 3 wherein the distance between said first forward attachment point and said first rearward attachment point is a substantial portion of the distance between said forward edge and said rearward edge of said one side wall and the distance between said second forward attachment point and said second rearward attachment point is a substantial portion of the distance between said forward edge and said rearward edge of said other side wall.

5. A suitcase as recited in claim 4 wherein said handle means is secured to said one side wall between said first forward attachment point and said first rearward attachment point generally perpendicularly between said forward edge and said rearward edge of said one side wall and is secured to said other side wall between said second forward attachment point and said second rearward attachment point generally perpendicularly between said forward edge and said rearward edge of said other side wall.

6. A suitcase comprising a body defined by a first vertically oriented side, a second vertically oriented side, a forward wall, an upper wall, a rearward wall and a lower wall;

first partition means in said body spaced from said first side for defining a first compartment in said body between said first partition means and said first side;

second partition means in said body spaced from said first partition means and from said second side for defining a second compartment between said second partition means and said second side and an intermediate compartment between said second partition means and said first partition means;

first closure means for selectively securing and releasing said first side with respect to said body to permit opening and closing of said second compartment;

second closure means for selectively securing and releasing said second side with respect to said body to permit opening and closing of said second compartment;

third closure means for selectively securing and releasing said first partition means with respect to said body to permit opening and closing of said intermediate compartment;

wheel means mounted on said body for supporting said body on the ground;

strap means secured on said body for pulling said body along the ground;

handle means secured on said first side and said second side for carrying said suitcase, said handle means being secured on said first and second sides proximate said lower wall; and support strap means connected to said handle means and attached on said first and second sides to extend over said upper wall for supporting said first and second sides.

7. A suitcase as recited in claim 6 further including fastener means on said support strap means for selectively locking said support strap means in a position supporting said first and second sides.

8. A suitcase as recited in claim 7 wherein said first, second and third closure means includes first, second and third zippers.

9. A suitcase as recited in claim 8 further including flaps for concealing said zippers.

10. A suitcase as recited in claim 9 further including grip means on said handle means for carrying said body by said handle means.

11. A suitcase as recited in claim 10 further including grip means on said strap means for pulling said body by said strap means.

12. A soft suitcase for holding articles comprising a body defined by a first vertically oriented side, a second vertically oriented side, a forward wall, an upper wall, a rearward wall and a lower wall;

first partition means in said body spaced from said first side for defining a first compartment between said first partition means and said first side;

first securing means in said body for securing articles in said first compartment against said first side;

second securing means in said body for securing articles in said first compartment against said first partition means, said second securing means including a sleeve having opposing open ends disposed adjacent said forward and rearward walls and a pair of flaps disposed in overlapping arrangement over said sleeve, one of said flaps being secured to said first partition means adjacent said upper wall and the other of said flaps being secured to said first partition means adjacent said lower wall;

second partition means in said body spaced from said second side and from said first partition means for defining a second compartment between said second partition means and said second side and an intermediate compartment between said second partition means and said first partition means;

third securing means in said body for securing articles in said second compartment against said second partition means;

a plurality of tubular pockets disposed on said second partition means in said intermediate compartment, said pockets having open upper ends disposed proximate said upper wall and open lower ends disposed proximate said lower wall;

an article receiving space defined between said upper ends and said upper wall;

closure means on said body for permitting selective opening and closing of said first, second and intermediate compartments; and wheel means mounted on said body for moving said body along the ground.

13. A suitcase as recited in claim 12 wherein said first securing means includes at least one strap in said first compartment secured on said first side.

14. A suitcase as recited in claim 13 wherein said third securing means includes at least one strap secured in said second compartment on said second partition means.

15. A suitcase as recited in claim 14 wherein said wheel means includes three wheels rigidly mounted on said lower wall proximate said forward wall and three wheels pivotally mounted on said lower wall proximate said rearward wall.

* * * * *